US012258101B2

(12) United States Patent
Curts et al.

(10) Patent No.: US 12,258,101 B2
(45) **Date of Patent: *Mar. 25, 2025**

(54) AFT-FACING TRANSOM SEATING FOR A BOAT

(71) Applicant: MasterCraft Boat Company, LLC, Vonore, TN (US)

(72) Inventors: Chadrick E. Curts, Lenoir City, TN (US); Daniel P. Vieira, Madisonville, TN (US); Rosemary M. Bennett, Seymour, TN (US); David F. Ekern, Knoxville, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/601,301

(22) Filed: Mar. 11, 2024

(65) Prior Publication Data

US 2024/0208612 A1 Jun. 27, 2024

Related U.S. Application Data

(63) Continuation of application No. 18/303,099, filed on Apr. 19, 2023, now Pat. No. 11,945,552, which is a (Continued)

(51) Int. Cl.
*B63B 3/54* (2006.01)
*B63B 3/46* (2006.01)

(Continued)

(52) U.S. Cl.
CPC ..... *B63B 3/54* (2013.01); *B63B 3/46* (2013.01); *B63B 27/14* (2013.01); *B63B 29/04* (2013.01);

(Continued)

(58) Field of Classification Search
CPC .. B63B 3/54; B63B 3/46; B63B 32/70; B63B 27/14; B63B 29/04; B63B 34/67; B63B 2029/043; B63H 1/14; B63H 21/12
See application file for complete search history.

(56) References Cited

U.S. PATENT DOCUMENTS 794,777 A 7/1905 Bunnell
3,964,785 A 6/1976 Plume (Continued)

OTHER PUBLICATIONS

MasterCraft, 2013 Owner's Manual, pp. cover, ix, 2-23 to 2-26, and 3-27 to 3-28.

(Continued)

*Primary Examiner* — Stephen P Avila
(74) *Attorney, Agent, or Firm* — Venable LLP

(57) ABSTRACT

A boat, having a transom, includes one or more aft-facing seats. Each aft-facing seat is positioned proximate to the transom and includes a seat bottom that is inclined at a downward angle in a direction extending from aft to fore, a seatback, a headrest, a seat support structure having at least one hidden compartment therein, and at least one pivot mechanism attached to the seatback and the headrest and configured to allow the seatback to move between a first position in which the seatback is capable of supporting the back of a person seated in the seat and a second position in which the seatback is pivoted upwardly to allow access to the compartment and the headrest to move between an upright position and a folded position. A plurality of handles may be provided for each aft-facing seat, with one at an outboard side and another at an inboard side.

20 Claims, 5 Drawing Sheets

Related U.S. Application Data continuation of application No. 17/333,651, filed on May 28, 2021, now Pat. No. 11,661,149, which is a continuation of application No. 16/804,394, filed on Feb. 28, 2020, now Pat. No. 11,027,795, which is a continuation of application No. 16/442,652, filed on Jun. 17, 2019, now Pat. No. 10,604,217, which is a continuation of application No. 15/587,674, filed on May 5, 2017, now Pat. No. 10,336,411, which is a continuation of application No. 14/845,606, filed on Sep. 4, 2015, now Pat. No. 9,650,117, which is a continuation-in-part of application No. 29/501,577, filed on Sep. 5, 2014, now Pat. No. Des. 743,318.

(60) Provisional application No. 62/046,394, filed on Sep. 5, 2014.

(51) Int. Cl.

| | |
|---|---|
| ***B63B 27/14*** | (2006.01) |
| ***B63B 29/04*** | (2006.01) |
| ***B63B 32/70*** | (2020.01) |
| ***B63B 34/67*** | (2020.01) |
| ***B63H 1/14*** | (2006.01) |
| ***B63H 21/12*** | (2006.01) |

(52) U.S. Cl.

CPC ..... *B63B 32/70* (2020.02); *B63H 1/14* (2013.01); *B63H 21/12* (2013.01); *B63B 2029/043* (2013.01); *B63B 34/67* (2020.02)

(56) References Cited

U.S. PATENT DOCUMENTS

| | | | | |
|---|---|---|---|---|
| 4,085,473 | A | 4/1978 | Franklin | |
| 4,879,963 | A | 11/1989 | Dionne | |
| D310,059 | S | 8/1990 | Porter | |
| D322,422 | S | 12/1991 | Carlson | |
| 5,136,963 | A | 8/1992 | Zuzik | |
| D333,810 | S | 3/1993 | Wenstadt | |
| 5,320,059 | A | 6/1994 | Ikeda | |
| 5,346,277 | A | 9/1994 | Holobaugh et al. | |
| D356,289 | S | 3/1995 | Trent | |
| D357,223 | S | 4/1995 | Thompson et al. | |
| 5,481,998 | A | 1/1996 | Trent | |
| 5,497,724 | A | 3/1996 | Brown et al. | |
| 6,041,732 | A | 3/2000 | Ikeda | |
| D429,682 | S | 8/2000 | Garland et al. | |
| 6,145,458 | A | 11/2000 | Hattori | |
| 6,257,667 | B1 | 7/2001 | Boren et al. | |
| 6,371,559 | B1 | 4/2002 | Kienzle et al. | |
| 6,431,109 | B1 | 8/2002 | Martin | |
| D464,601 | S | 10/2002 | Aube et al. | |
| 6,491,124 | B1 | 12/2002 | Thompson et al. | |
| D469,053 | S | 1/2003 | Aube et al. | |
| 6,672,240 | B1 | 1/2004 | Aube et al. | |
| 6,837,173 | B2 | 1/2005 | Eck et al. | |
| 6,886,490 | B2 | 5/2005 | Aube et al. | |
| 7,000,557 | B1 | 2/2006 | Forbes et al. | |
| D524,224 | S | 7/2006 | Guay et al. | |
| 7,197,998 | B1 * | 4/2007 | Rice | B63B 34/67 114/254 |
| 7,255,058 | B2 | 8/2007 | Forbes et al. | |
| 7,661,382 | B2 | 2/2010 | Wood et al. | |
| D665,719 | S | 8/2012 | Watkins et al. | |
| D679,236 | S | 4/2013 | Gros et al. | |
| 8,517,466 | B1 | 8/2013 | Wizorek et al. | |
| 8,616,143 | B2 | 12/2013 | Hancock, Jr. et al. | |
| D700,127 | S | 2/2014 | Fuller, IV | |
| 8,943,988 | B1 | 2/2015 | Guglielmo et al. | |
| 9,079,638 | B2 | 7/2015 | Ricciardi et al. | |
| 9,650,117 | B2 | 5/2017 | Curts et al. | |
| 10,336,411 | B2 | 7/2019 | Curts et al. | |
| 10,604,217 | B2 | 3/2020 | Curts et al. | |
| 11,027,795 | B2 * | 6/2021 | Curts | B63B 3/46 |
| 11,945,552 | B2 * | 4/2024 | Curts | B63B 32/70 |
| 2008/0196649 | A1 | 8/2008 | Kalil | |
| 2009/0301378 | A1 | 12/2009 | Walbridge et al. | |
| 2010/0037814 | A1 | 2/2010 | Sahr et al. | |
| 2010/0319604 | A1 | 12/2010 | Mayrand et al. | |
| 2011/0095592 | A1 | 4/2011 | Willard et al. | |
| 2013/0160695 | A1 | 6/2013 | Gratz et al. | |
| 2014/0225403 | A1 | 8/2014 | Shimada et al. | |

OTHER PUBLICATIONS

Charles Plueddeman, Surf Everywhere, Boating, Mar. 2015, pp. cover, 10, 68-73.

The AL-24 Wake Boat, http://pevati.com/al-24/, last visited Aug. 4, 2014.

Bombardier Recreational Products Inc., 210 Wake, Aug. 4, 2011.

Yamaha Motor Corporation, 2014 Yamaha Boats.

Sea Ray Boats, 300 Sundeck, Sep. 2012.

Chaparral Boats, 2013 Chaparral Fleet Brochure, available at http://www.chaparralboats.com/publications/uploaded_files/121/2013-ChapMini.pdf.

Randy Vance, Cobalt A25, Boating, Apr. 29, 2010, available at http://www.boatingmag.com/boats/cobalt-a25?image=3.

Metal Moulding Corp., Slide Out, Flip up, Rotating Hinge, http://www.metalmoulding.com/Slide_out_flip_up_rotating_hinge.html (last visited Aug. 31, 2015).

Gary Polson; "Swim Platform Seats: An Attractive Nuisance to Children, Youth, & Adults?;" PropellerSafety.com; available at http://www.propellersafety.com/6893/legal-propeller/swim-platform-seats-attractive-nuisance/ (accessed Jun. 23, 2022).

"Glastron GTS 187 2014 for sale for $24,000—Boats-from-USA;" boats-from-usa.com; available at https://boats-from-usa.com/glastron/glastron-gts-187-78531 (accessed Jun. 23, 2022).

* cited by examiner

AFT-FACING TRANSOM SEATING FOR A BOAT

CROSS REFERENCE TO RELATED APPLICATIONS

This application is a continuation of U.S. patent application Ser. No. 18/303,099, filed Apr. 19, 2023. U.S. patent application Ser. No. 18/303,099 is a continuation of U.S. patent application Ser. No. 17/333,651, filed May 28, 2021, now U.S. Pat. No. 11,661,149. U.S. Patent Application No. 17/333,651 is a continuation of U.S. patent application Ser. No. 16/804,394, filed Feb. 28, 2020, now U.S. Pat. No. 11,027,795. U.S. patent application Ser. No. 16/804,394 is a continuation of U.S. patent application Ser. No. 16/442,652, filed Jun. 17, 2019, now U.S. Pat. No. 10,604,217.U.S. patent application Ser. No. 16/442,652 is a continuation of U.S. Patent Application No. 15/587,674, filed May 5, 2017, now U.S. Pat. No. 10,336,411. U.S. Patent Application No. 15/587,674 is a continuation of U.S. patent application Ser. No. 14/845,606, filed Sep. 4, 2015, now U.S. Pat. No. 9,650,117. U.S. patent application Ser. No. 14/845,606 claims the benefit under 35 U.S.C. § 119 (e) of U.S. Provisional Patent Application No. 62/046,394, filed Sep. 5, 2014, and titled "Aft-Facing Transom Seating for a Boat." This application U.S. patent application Ser. No. 14/845,606 is also a continuation-in-part of U.S. patent application Ser. No. 29/501,577, filed Sep. 5, 2014, now U.S. Design Patent No. D743,318. The foregoing applications are incorporated herein by reference in their entireties.

FIELD OF THE INVENTION

This invention relates to aft-facing seating for a boat, particularly aft-facing seating positioned proximate to the transom of the boat.

BACKGROUND OF THE INVENTION

Boats are used to tow watersports performers, such as water skiers, wakeboarders, and the like, using a tow-line. The performer holds onto one end of the tow-line and the other end is attached to the boat. A boat may also be used to generate a wake on which a watersports performer, such as a wake-surfer, may wake-surf. People in the boat often desire to watch the watersports performer, and in some states, a spotter is required by law. Because the watersports performers are behind the boat, it is desirable to have an aft-facing seat, and in particular, one positioned near the transom, to be as close to the action as possible. Further, the aft-facing seat should be one that can be safely occupied while the boat is moving.

SUMMARY OF THE INVENTION

In one aspect, the invention relates to a boat including a hull, an aft-facing seat, and a plurality of handles. The hull includes a bow, a transom, and port and starboard sides. The aft-facing seat is positioned proximate to the transom and includes a seat bottom that is inclined at a downward angle in a direction extending from aft to fore. One of the plurality of handles is positioned at an outboard side of the aft-facing seat and another one of the handles positioned an inboard side of the aft-facing seat.

In another aspect, the invention relates to a boat including a hull and an aft-facing seat. The hull includes a bow, a transom, and port and starboard sides. The aft-facing seat is positioned proximate to the transom and includes a seat bottom, a seatback, a headrest, and a seat support structure having at least one hidden compartment therein. The aft-facing seat also includes at least one pivot mechanism attached to the seatback and the headrest and configured to allow (1) the seatback to move between a first position in which the seatback is capable of supporting the back of a person seated in the seat and a second position in which the seatback is pivoted upwardly to allow access to the compartment and (2) the headrest to move between an upright position and a folded position.

In a further aspect, the invention relates to a boat including a hull, an aft-facing seat, and a plurality of handles. The hull includes a bow, a transom, and port and starboard sides. The aft-facing seat is positioned proximate to the transom and includes a seat bottom, a seatback, a headrest, and a seat support structure having at least one hidden compartment therein. The seat bottom is inclined at a downward angle in a direction extending from aft to fore. The aft-facing seat also includes at least one pivot mechanism attached to the seatback and the headrest and configured to allow (1) the seatback to move between a first position in which the seatback is capable of supporting the back of a person seated in the seat and a second position in which the seatback is pivoted upwardly to allow access to the compartment and (2) the headrest to move between an upright position and a folded position. One of the plurality of handles is positioned at an outboard side of the aft-facing seat and another one of the handles positioned an inboard side of the aft-facing seat.

In still another aspect, the invention relates to a boat including a hull, a plurality of aft-facing seats, and a plurality of handles associated with each aft-facing seat. The hull includes a bow, a transom, and port and starboard sides. A first aft-facing seat is positioned port of a centerline of the boat and proximate to the transom, and a second aft-facing seat is positioned starboard of the centerline of the boat and proximate to the transom. Each aft-facing seat includes a seat bottom, a seatback, a headrest, and a seat support structure having at least one hidden compartment therein. The seat bottom is inclined at a downward angle in a direction extending from aft to fore. Each aft-facing seat also includes at least one pivot mechanism attached to the seatback and the headrest and configured to allow (1) the seatback to move between a first position in which the seatback is capable of supporting the back of a person seated in the seat and a second position in which the seatback is pivoted upwardly to allow access to the compartment and (2) the headrest to move between an upright position and a folded position. One of the plurality of handles is positioned at an outboard side of each aft-facing seat and another one of the handles positioned an inboard side of each aft-facing seat.

These and other aspects of the invention will become apparent from the following disclosure.

DETAILED DESCRIPTION OF THE PREFERRED EMBODIMENTS

As used herein, directional terms forward (fore), aft, inboard, and outboard have their commonly understood meaning in the art. Relative to the boat, forward is a direction towards the bow, and aft is a direction towards the stern. Likewise, inboard is a direction toward the center of the boat and outboard is a direction away from it.

Figure 1:
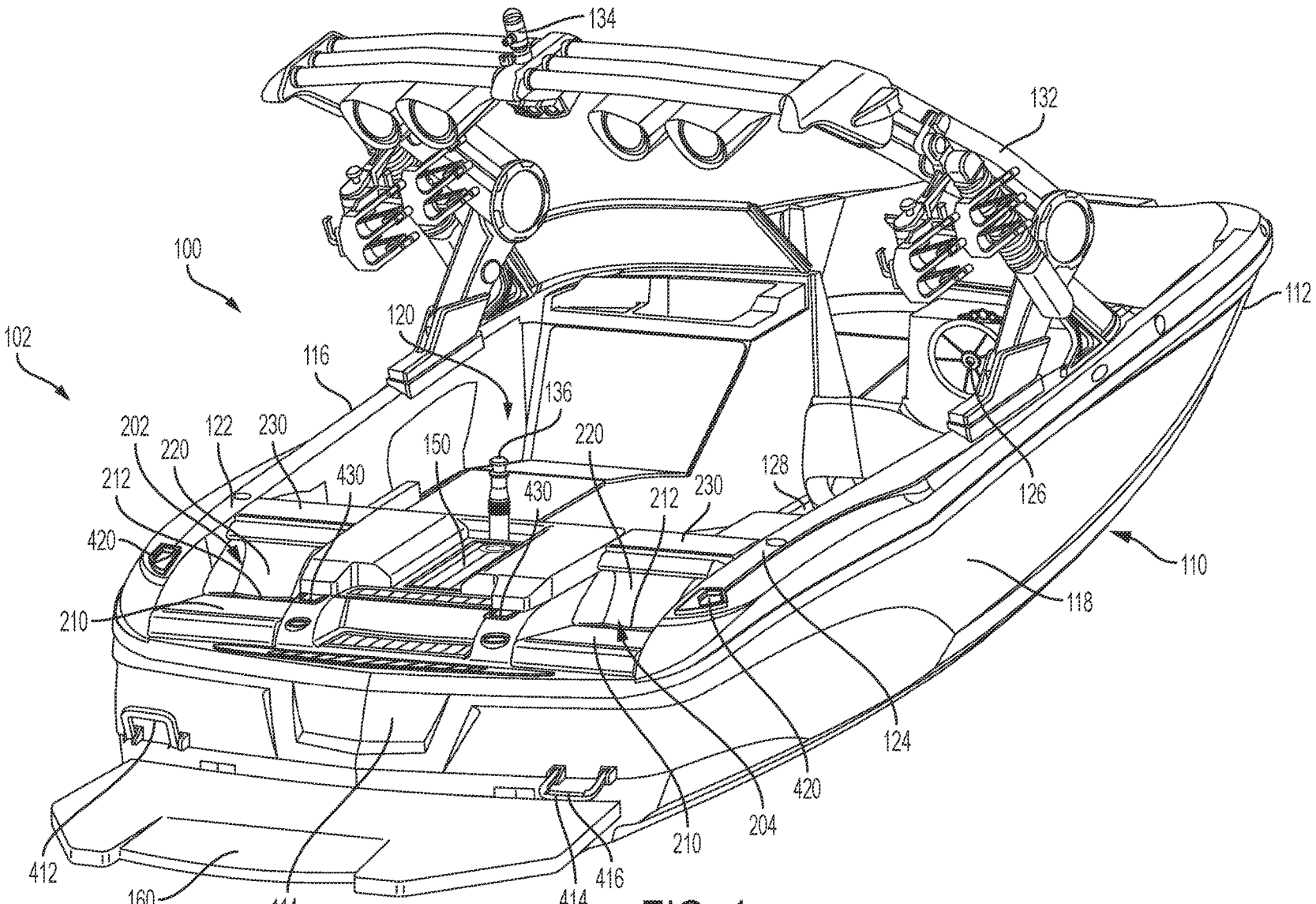
FIG. 1 shows a boat including a pair of aft-facing seats according to a preferred embodiment of the invention.

FIG. 1 shows a boat 100 equipped with a pair of aft-facing seats 202, 204 in accordance with an exemplary preferred embodiment of the invention. The boat 100 includes a hull 110 with a bow 112, a transom 114, a port side 116, and a starboard side 118. The port and starboard sides 116, 118 have port and starboard gunwales 122, 124, respectively. Collectively, the bow 112, the transom 114, and the port and starboard sides 116, 118 define an interior 120 of the boat 100. Within the boat's interior 120 is a control console 126 for operating the boat 100 and a floor 128. Typically, the floor 128 is oriented in a plane that is parallel with the horizontal plane of the boat 100.

The boat 100 is also preferably equipped with at least one apparatus for towing a watersports performer. The apparatus may include, for example, a tower 132 equipped with a tow point 134 for towing a watersports performer such as a wakeboarder. The tow point 134 may include, for example, an integrated light and tow-line-attachment assembly such as described in U.S. Pat. No. 6,539,886. Other devices may be attached to the tower 132 including, for example, speakers and racks for holding wakeboards. The boat 100 may also be equipped with a ski pylon 136 for towing a watersports performer such as a water skier.

Figure 2:
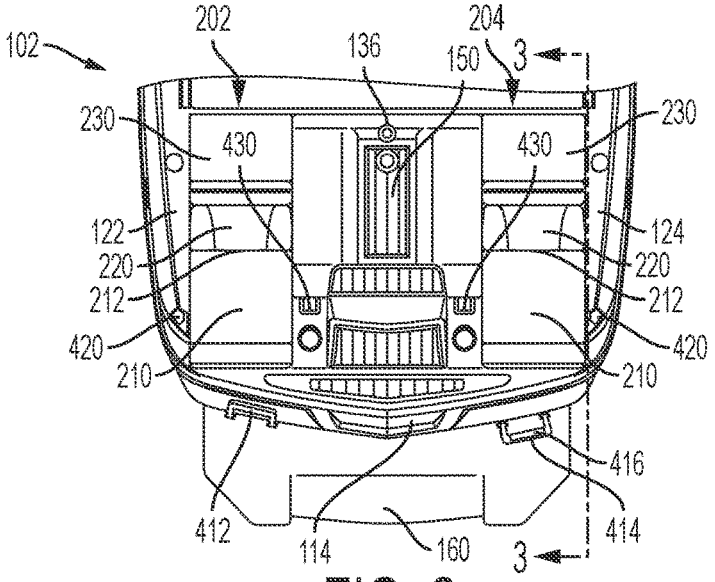
FIG. 2 is a top view of the stern of the boat shown in FIG. 1.
Figure 3:
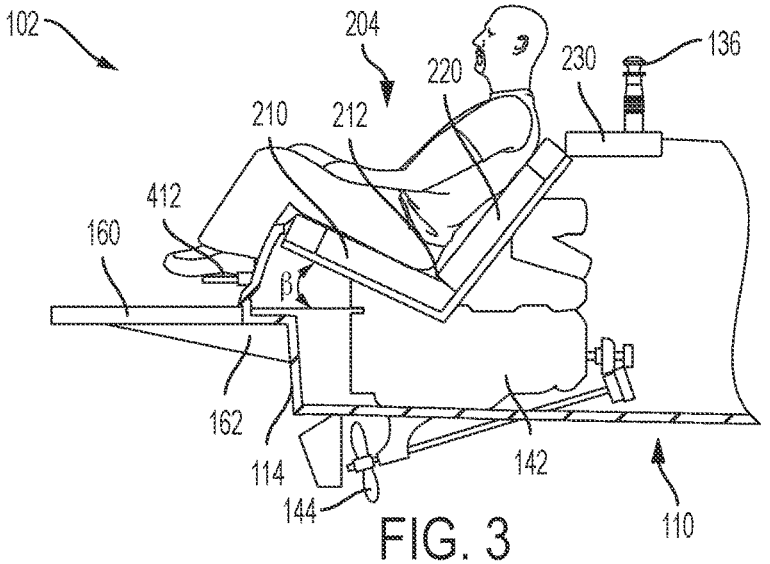
FIG. 3 is a cross-sectional view of the boat shown in FIG. 2 taken along line 3-3.
Figure 4:
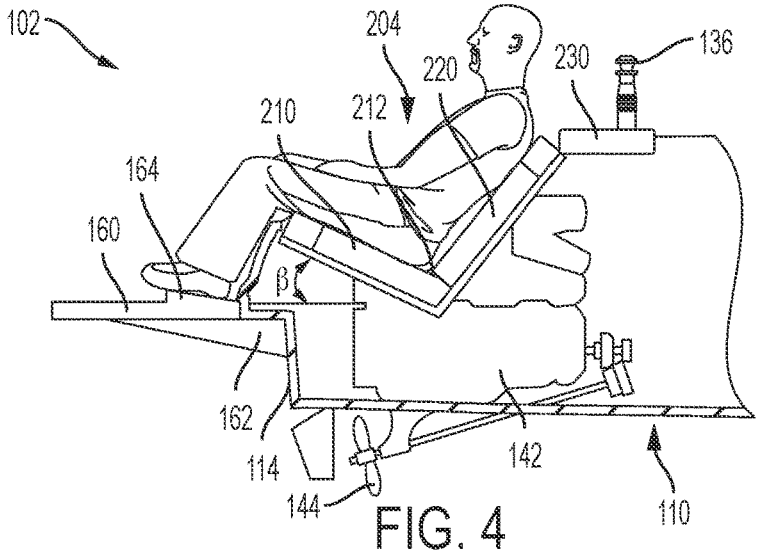
FIG. 4 is a cross-sectional view of the boat shown in FIG. 2 taken along line 3-3, having an alternate configuration of the swim platform.

FIGS. 3 and 4 show an inboard boat 100, which uses a motor 142 to drive a propeller 144 that is located under the hull 110 and forward of the transom 114. Inboard boats are often preferred for watersports because the propeller 144 is positioned underneath the boat 100 and away from watersports performers and swimmers. As shown in FIGS. 1 and 2, a motor box 150, located in the stern 102 of the boat 100, houses the motor 142. Preferably, the motor 142 and the motor box 150 are positioned proximate to the transom 114 to increase the displacement into the water of the stern 102 of the hull 110 for watersports such as wakeboarding and surfing. Any suitable motor 142 may be using including the MV8 5.7 L engine manufactured by Ilmor Marine of Mooresville, NC. The motor 142 is preferably positioned along the center line of the boat 100, thus leaving room between the motor 142 and the port and starboard sides 116, 118 of the hull 110 for compartments 250 (see, e.g., FIGS. 7 and 8).

The boat 100 includes a horizontal swim platform 160 attached to the transom 114 to make it easier for people to get into the water from the boat 100 or out of the water into the boat 100. The swim platform 160 should be capable of supporting a human, and is preferably capable of supporting at least 500 lbs., and even more preferably 1250 lbs. The swim platform 160 may be constructed from any suitable material that may be used in a marine environment including, for example, fiberglass and teak. In this embodiment, the swim platform 160 is attached to the transom 114 of the boat 100 using two brackets 162. In this embodiment, the fasteners used to attach the brackets 162 to the swim platform 160 and the transom 114 are screws; however, any suitable means of attachment known in the art may be used including but not limited to bolts, rivets, welding, adhesive, and the like. Alternatively, the brackets 162 may be integrally formed into either the swim platform 160 or the transom 114 of the boat 100. Similarly, the swim platform 160 may be attached to the transom 114 by any suitable means and is not limited to the use of brackets 162. While the swim platform 160 is described as an attachable/detachable platform, it is not so limited. For example, the swim platform 160 may be integrally formed with the stern 102 of the boat 100.

The pair of aft-facing seats 202, 204 is located in the stern 102 of the boat 100. FIG. 2 is a top view of the stern 102 of the boat 100 showing the pair of aft-facing seats 202, 204, and FIG. 3 is a cross-sectional view of the stern 102 of the boat 100 taken along line 3-3 in FIG. 2. A port side aft-facing seat 202 ("port seat") is located on the port side of the centerline of the boat 100, and a starboard side aft-facing seat 204 ("starboard seat") is located on the starboard side of the centerline of the boat 100. As shown in this embodiment, the person faces directly aft when the seat is occupied; that is, the plane of a seatback 220 of the aft-facing seat 202, 204 is generally orthogonal to the centerline of the boat 100. However, the aft-facing seats 202, 204 do not need to be positioned to face the occupant directly aft. Instead, some deviations are contemplated to be within the scope of the invention, including, for example, angling the seatback 220 up to and including 45° relative to the centerline of the boat 100.

The aft-facing seats 202, 204 are designed to be occupied by a person while the boat 100 is either moving or at rest. Preferably, the aft-facing seats 202, 204 may be safely occupied while the boat 100 is moving at speeds appropriate for watersports such as water skiing (from 28 mph to 36 mph), wakeboarding (from 18 mph to 26 mph), and wake surfing (from 8 mph to 14 mph). As will be apparent from the discussion below, there are a number of features of the boat 100 that enable a person to safely occupy the aft-facing seats 202, 204 when the boat 100 is moving. Those skilled in the art will recognize that each of these features may be used in various combinations to achieve this non-limiting objective of the invention.

The pair of aft-facing seats 202, 204 are supported by a seat support structure 240 (see FIGS. 7 and 8) which, in this embodiment, is the motor box 150. Each aft-facing seat 202, 204 has seat bottom 210 and a seatback 220. The seat bottom 210 and the seatback 220 each have a structural member with a cushion covering the structural member. Preferably, the cushions are constructed from a soft, but supportive, material, such as triple-density foam, and are covered with a waterproof material, such as premium grade vinyl. Although they may be separate pieces, in this embodiment, the seat bottom structural member and the seatback structural member are an integral piece (collectively referred to as a seat structural member). The seat structural member may be made from any structural material suitable for the marine environment and capable of supporting the weight of an adult. Because the aft-facing seats 202, 204 are designed to be lifted (discussed further below), the structural members may be constructed from a light weight material, such as polyethylene, and made by rotomolding (also known as rotocasting). The seat structural member is generally L-shaped and the seat bottom structural member intersects with the seatback structural member at an intersecting point 212. The angle α (see FIG. 5) between a top surface of the seat bottom 210 and an aft-facing surface of the seatback 220 is set so that a person can comfortably sit in the seat 202, 204. Preferably, this angle α is 90° or greater, more preferably from 95° to 135°.

The aft-facing seats 202, 204 are positioned proximate to the transom 114 of the boat 100. In the embodiment shown in FIGS. 1-8, the aft-facing seats 202, 204 are positioned over the transom 114, and in particular, the seat bottom 210 is positioned above the transom 114. While seated in one of the aft-facing seats 202, 204, the majority of an adult's body is positioned forward of the transom 114, as shown in FIG. 3, and his or her legs extend aft, over the transom 114.

One feature of the aft-facing seats 202, 204, which allows one to safely occupy the aft-facing seats 202, 204 while the boat 100 is moving, is the positioning of the occupant's hips while seated. When seated, the occupant's hips are preferably positioned forward of the transom 114 and lower than the gunwales 122, 124. Thus the intersecting point 212 of the port seat 202 is forward of the transom 114 and lower than the port gunwale 122, and the intersecting point 212 of the starboard seat 204, is forward of the transom 114 and lower than the starboard gunwale 124. The amount by which the intersecting point 212 is lower than the gunwales 122, 124 (as measured to the top of the seat cushions) is preferably from 10 inches to 16 inches, which is similar to level of the seats in the boat's interior 120 relative to the gunwales 122, 124.

Another feature of the aft-facing seats 202, 204, which allows one to safely occupy the aft-facing seats 202, 204 while the boat 100 is moving, is the inclination of the seat bottom 210. The seat bottom 210 is inclined at a downward angle β in a direction extending from aft to fore. This inclination helps keep the occupant pressed against the back of the aft-facing seat 202, 204 when the boat 100 is moving. Because the bow 112 of the boat 100 may rise as the boat 100 accelerates and moves through the water, the angle β of the seat bottom 210 preferably compensates for the inclination of the boat 100 to maintain a downward angle while the boat 100 is in motion. Preferably, the downward angle β of the seat bottom 210 is from 5° to 20° relative to the floor 128 of the boat 100, more preferably 18° relative to the floor 128.

As shown in FIG. 3, the boat 100 includes a pair of footrests 412, 414. Each footrest 412, 414 is associated with one of the aft-facing seats 202, 204. One footrest 412 is on the port side of the centerline of the boat 100 and positioned below the seat bottom 210 of the port seat 202. The other footrest 414 is on the starboard side of the centerline of the boat 100 and positioned below the seat bottom 210 of the starboard seat 204. When a person sits in the aft-facing seat 202, 204, his or her feet may rest on an upper surface 416 the associated footrest 412, 414. The occupant may push against the upper surface 416 of the footrest 412, 414 with his or her feet. By pushing on the footrest 412, 414, the occupant pushes themselves back in the aft-facing seat 202, 204, which facilitates using the aft-facing seat 202, 204 when the boat 100 is in operation. The upper surface 416 of the footrest 412, 414 is preferably inclined, with the aftmost part of the upper surface 416 being higher than the foremost part of the upper surface 416. The upper surface 416 is preferably inclined from 10° to 50° relative to the floor 128 of the boat 100.

The footrests 412, 414 may be movable between an extended position, in which the occupant of the associated aft-facing seat 202, 204 may place his or her feet on the upper surface 416 of the footrest 412, 414, and a retracted position. As shown in FIGS. 1 and 2, the port footrest 412 is in the retracted position and the starboard footrest 414 is in the extended position. In FIGS. 1-4, for example, the footrest 412, 414 is pivotable between the extended position and the retracted position. In the extended position, the footrest 412, 414 extends in the aft direction from the transom 114 and is generally perpendicular to the transom 114. In the retracted position, the footrest 412, 414 is pivoted upward so that it is substantially flush with the transom 114.

FIG. 4 shows an alternative arrangement where, instead of the occupant of the aft-facing seat 202, 204 placing his or her feet on a footrest 412, 414, the occupant may place his or her feet on the swim platform 160. In this case, the swim platform 160 is preferably designed to have comfortable footrest 164 below each of the aft-facing seats 202, 204. As with the footrests 412, 414, the footrest 164 on the swim platform 160 is preferably inclined with the aftmost part of the footrest 164 being higher than the foremost part of the footrest 164.

As shown in FIGS. 1 and 2, the boat 100 is further equipped with a plurality of handles 420, 430, which allow one to safely occupy the aft-facing seats 202, 204 while the boat 100 is moving. These handles 420, 430 are positioned so that a person can grasp the handles 420, 430 while seated in one of the aft-facing seats 202, 204. Two handles 420, 430 may be used with each aft-facing seat 202, 204. One handle 420 is at an outboard side of each aft-facing seat 202, 204 and the other handle 430 is at an inboard side of each aft-facing seat 202, 204. The handles 420, 430 are positioned a distance aft of the seatback 220 such that they can be comfortably grasped by a person with their arms bent at the elbows. Preferably, both handles 420, 430 are positioned at the same height. In the embodiment shown, the outboard handle 420 is at substantially the same height as the top of the gunwales 122, 124, and the inboard handle 430 is located on the motor box 150 adjacent to the aft-facing seat 202, 204. These handles 420, 430 are positioned on the boat 100 to avoid interference with the seat bottom 210 and seatback 220 when they are moved upward to their second position (as discussed below). The handles 420, 430 may, however, overlap the seat bottom 210 or be designed to move with the seat bottom 210 and seatback 220.

In addition to being designed to be safely occupied while the boat 100 is moving, the aft-facing seats 202, 204 are designed for convenience and comfort, with features such as a headrest 230 and the ability to be move the seat bottom 210 and/or the seat back 220 in order access compartments 250 below and/or behind the aft-facing seats 202, 204.

Figure 5:
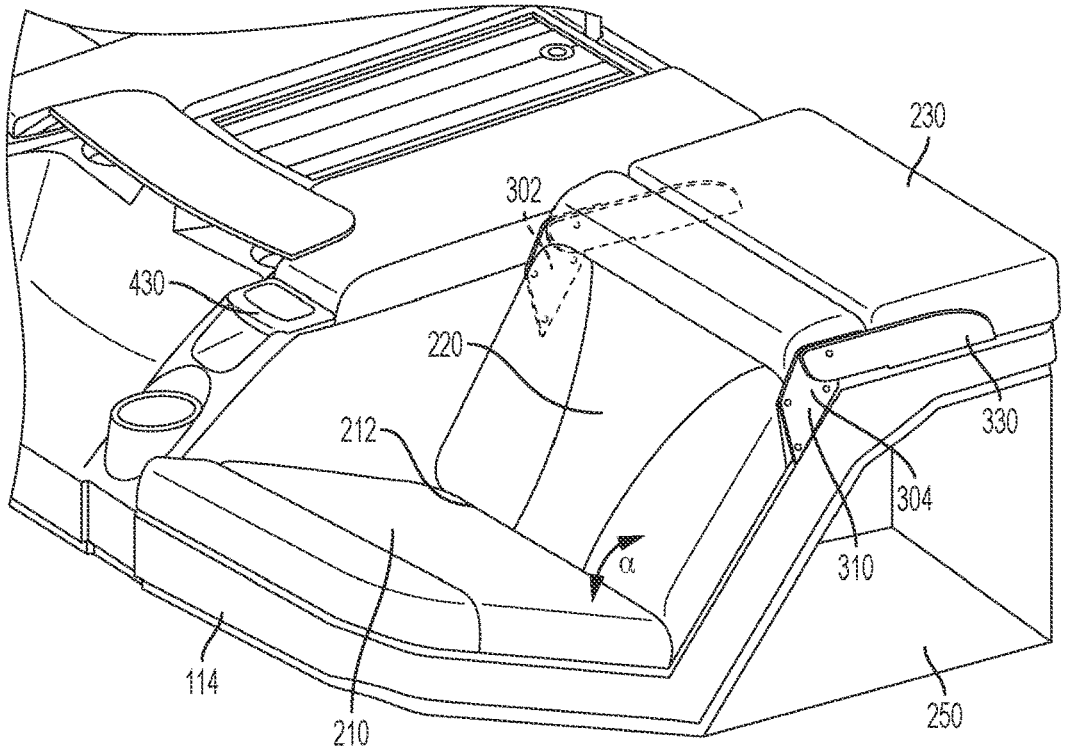
FIG. 5 is a perspective view of the starboard aft-facing seat shown in FIG. 3.
Figure 6:
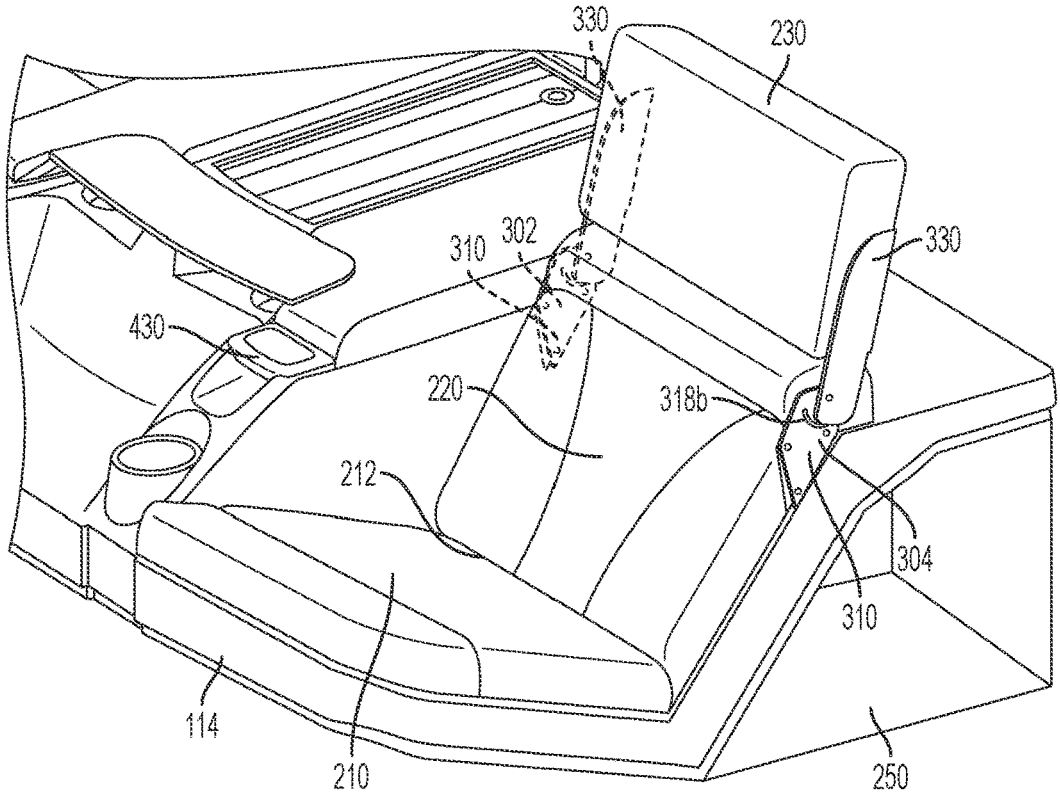
FIG. 6 is a perspective view of the starboard aft-facing seat shown in FIG. 5 with the headrest in an upright position.
Figure 7:
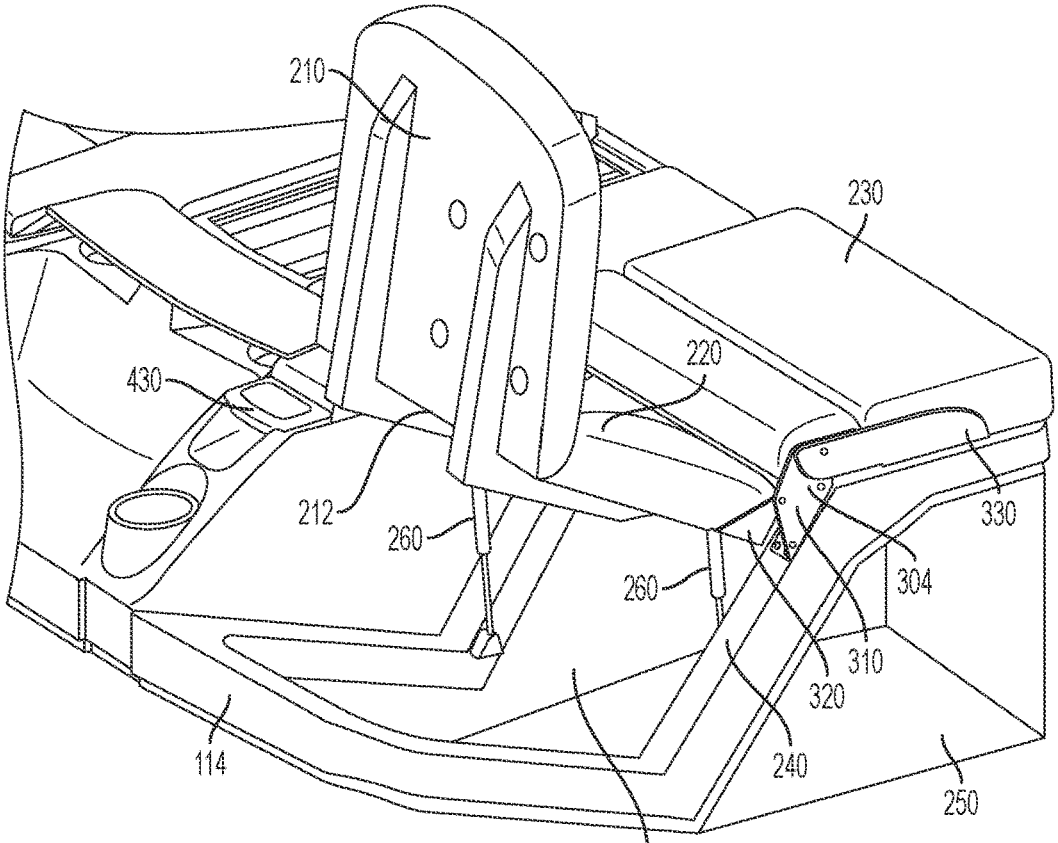
FIG. 7 is a perspective view of the starboard aft-facing seat shown in FIG. 5 with the seatback pivoted upward.
Figure 8:
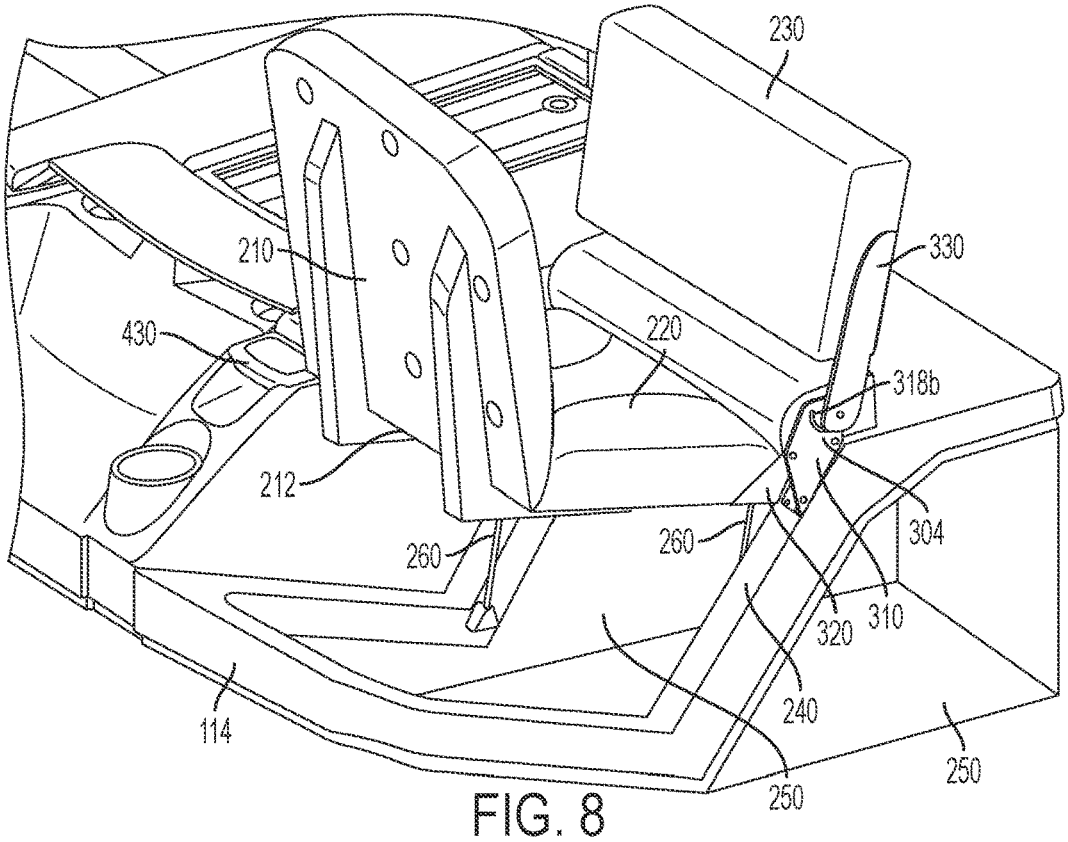
FIG. 8 is a perspective view of the starboard aft-facing seat shown in FIG. 5 with the headrest in the upright position and the seatback pivoted upward.

In the preferred embodiment shown in FIGS. 1-8, each aft-facing seat 202, 204 includes a headrest 230. The headrest 230 is moveable between an upright position and folded position. FIGS. 1-5 and 7 show the headrest 230 in the folded position and FIGS. 6 and 8 show the headrest 230 in the upright position. Like the seat bottom 210 and the seatback 220, in this embodiment, the headrest 230 is made from a cushion covered with a premium grade vinyl supported by a structural member. The headrest 230 is attached to two pivot mechanisms 302, 304 (discussed further below) to pivot between the upright and folded positions.

As discussed above, the boat 100 preferably includes two compartments 250 on either side of the motor 142. Watersports performers often use the swim platform 160 to put on and adjust their equipment, for example, tow ropes, life jackets, water skis, wakeboards, etc. By allowing access to these compartments 250 from the swim platform 160, these compartments 250 can conveniently be used to store equipment for watersports performers. Each aft-facing seat 202, 204 is moveable to allow access to the compartment 250 from the swim platform 160. In this embodiment, the seatback 220 is pivotable between a first position in which the seatback 220 is capable of supporting the back of a person seated in the aft-facing seat 202, 204 and a second position in which the seatback 220 is pivoted upwardly to allow access to the compartment 250. The seat bottom 210 is also movable between a first position in which the seat bottom 210 is capable of supporting the bottom of a person seated in the aft-facing seat 202, 204 and a second position in which the seatback 220 is pivoted upwardly to allow access to the portion of the compartment 250 below the seat bottom 210. In this embodiment, the seat bottom 210 and seatback 220 pivot together because they are integrally formed, but in other embodiments, they can be moved separately, or only one of the seat bottom 210 and the seatback 220 may be moveable. FIGS. 1-6 show the seatback 220 in the first position, and FIGS. 7 and 8 show the seatback 220 in the second position.

The seat bottom 210 and the seatback 220 pivot between the first and second position using a pair of pivot mechanisms 302, 304. In the embodiment shown in FIGS. 5-10, the pivot mechanisms 302, 304 used for the headrest 230 are the same pivot mechanisms 302, 304 used for the seatback 220. A first pivot mechanism 302 is located on an inboard side of the seat support structure 240, and a second pivot mechanism 304 is located on an outboard side of the seat support structure 240. Both the first and second pivot mechanisms 302, 304 are symmetrical and the following description of the second pivot mechanism 304 of the starboard seat 204 applies equally to the first pivot mechanism 302 of the starboard seat 204, as well as to both pivot mechanisms 302, 304 of the port seat 202.

Figure 9:
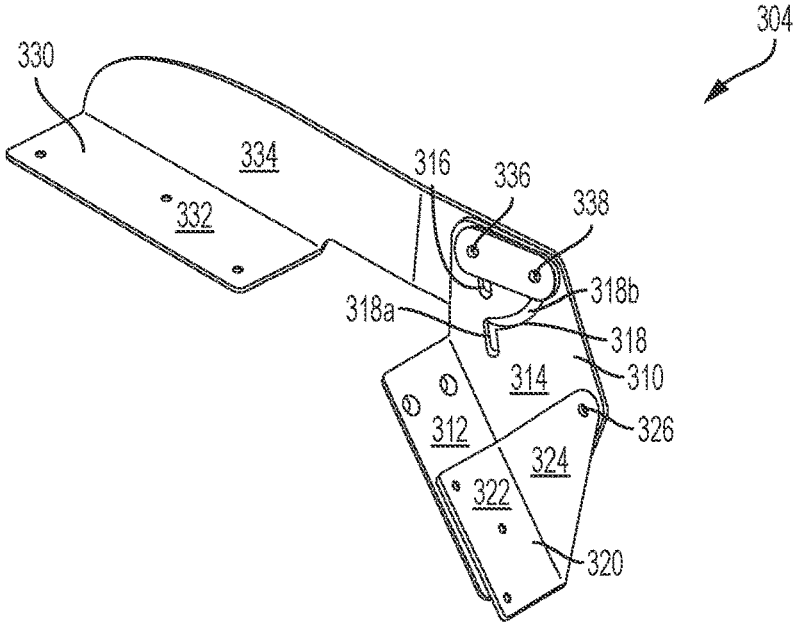
FIG. 9 is a perspective view of a pivot mechanism according to a preferred embodiment of the invention.
Figure 10:
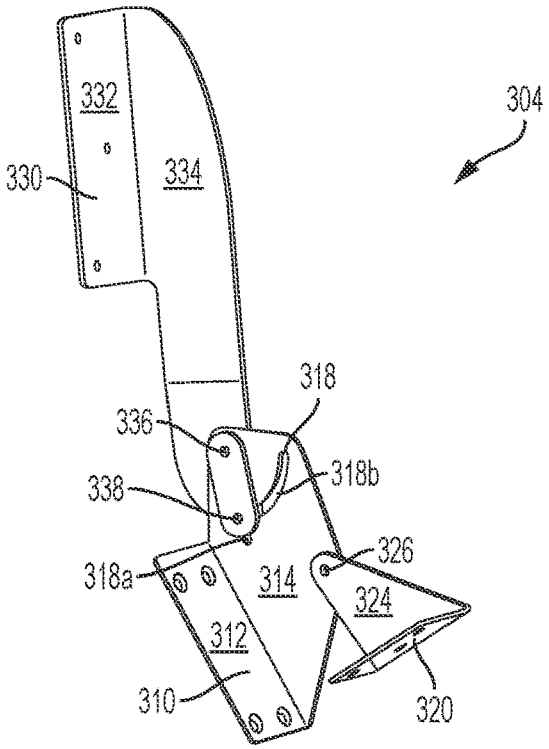
FIG. 10 is a perspective view of the pivot mechanism shown in FIG. 9 with a headrest bracket in an upright position and a seatback bracket pivoted upward.

As shown in FIGS. 9 and 10, the second pivot mechanism 304 of the starboard seat 204 has three brackets, a base bracket 310, a backrest bracket 320, and a headrest bracket 330. All three brackets 310, 320, 330 are generally L-shaped. The base bracket 310 has a first surface 312 which is mounted to the seat support structure 240 using fasteners. In this embodiment, the fasteners used to attach the base bracket 310 to the seat support structure 240 are screws; however, any suitable means of attachment known in the art may be used including bolts, rivets, welding, adhesive, and the like. The base bracket 310 is mounted near the top of the support structure 240 and near both the seatback 220 and the headrest 230. The base bracket 310 also has a second surface 314 which is generally perpendicular to the first surface 312 to form the L-shape of the bracket. Both the backrest bracket 320 and the headrest bracket 330 are pivotably connected to the second surface 314 of the base bracket 310.

The backrest bracket 320 also includes a first surface 322 and a second surface 324, which is generally perpendicular to the first surface 322. The first surface 322 of the backrest bracket 320 is connected to the backrest 220. In this embodiment, the first surface 322 is directly connected to the backrest 220 using fasteners, including, for example, screws; however any suitable means of attachment known in the art may be used including bolts, rivets, welding, adhesive, and the like. The second surface 324 of the backrest bracket 320 is pivotably connected to the base bracket 310. In this embodiment, the pivotable connection is made using a pin 326, such as the shank of a rivet, but any suitable pivotable connection may be used. The pin 326 is inserted through a holes formed on both the second surface 314 of the base bracket 310 and the second surface 324 of the backrest bracket 320. Both holes are located on a side of the second surfaces 314, 324 that is away from their respective first surfaces 312, 322. This configuration allows the backrest bracket 320 to freely pivot about the pivotable connection between the first position (see FIG. 9) and the second position (see FIG. 10), and allows the backrest bracket 320 to nest above the base bracket 310 in the first position, as shown in FIGS. 5, 6, and 9.

The aft-facing seats 202, 204 may also include features to help lift the seat bottom 210 and the seatback 220 and hold them in the second position. Such features may include, for example, pneumatic cylinders 260. One end of each pneumatic cylinder 260 may be attached to the seat support structure 240 and the other may be attached to the seatback 220, as shown in FIGS. 7 and 8.

Similar to the base bracket 310 and the backrest bracket 320, the headrest bracket 330 includes a first surface 332 and a second surface 334, which is generally perpendicular to the first surface 332. The first surface 332 of the headrest bracket 330 is connected to the headrest 230. In this embodiment, the first surface 332 is directly connected to the headrest 230 using fasteners, including, for example, screws; however any suitable means of attachment known in the art may be used including bolts, rivets, welding, adhesive, and the like. The second surface 334 of the headrest bracket 330 is elongated with one end pivotally connected to the base bracket 310. The headrest 230 and headrest bracket 330 pivot about this pivotable connection to move between the folded and the upright positions. Preferably, the pivotable connection is designed to hold the headrest 230 in the upright position.

In this embodiment, the headrest bracket 330 is pivotably connected to the base bracket 310 by two pins 336, 338, a first pin 336 and a second pin 338. The first pin 336 engages a first slot 316 formed in the second surface 314 of the base bracket 310, and the second pin 338 engages with a second slot 318 formed in the second surface 314 of the base bracket 310. In this embodiment, the first and second pins 336, 338 are shanks of rivets, but any pin or other connection suitable for moving in the first and second slots 316, 318 may be used.

The first slot 316 is generally linear and oriented along a first linear path. In this embodiment, the first linear path is generally parallel to a bottom surface of the structural member of the headrest 230 in the upright position. The first slot 316 has two ends, an upper end and a lower end. The upper end is closer to the headrest 230 than the lower end.

In this embodiment, the second slot 318 is located farther from the headrest 230 than the first slot 316 is from the headrest 230. The second slot 318 has two portions, a linear portion **318*a* and a curved portion 318*b*. The linear portion 318*a* of the second slot 318 is oriented along a line that is parallel to the first linear path. Preferably, the linear portion 318*a* of the second slot 318 is co-linear with the first slot 316; that is, both the first slot 316 and the linear portion 318*a* of the second slot 318 are oriented along the first linear path. The linear portion 318*a* of the second slot 318 has two ends, an upper end and a lower end. The upper end is the end closest to the first slot 316. The curved portion 318*b* of the second slot 318 extends from the upper end of the linear portion 318*a* and extends in a direction away from the first surface 312 of the base bracket 310. The curved portion 318***b* of the second slot 318 also has two ends, an upper end and a lower end. The lower end of the curved portion 318*b* is the upper end of the linear portion 318*a*.

The first and second pins 336, 338 slide in the first and second slots 316, 318, respectively, to allow the headrest 230 to move between the folded and the upright positions. Starting in the folded position, the first pin 336 is located in the upper end of the first slot 316 and the second pin 338 is located in the upper end of the curved portion 318*b* of the second slot 318. The first pin 336 and second pin 338 are set at a constant distance apart. The curved portion 318*b* is curved with a radius centered on the upper end of the first slot 316 and equal to the distance between the first pin 336 and the second pin 338. To move the headrest 230 from the folded position (shown in FIG. 5), a user lifts the headrest 230 and rotates it to the upright position (shown in FIGS. 6 and 8). The headrest bracket 330 is shown in the folded position in FIG. 9. As the headrest 230 is raised, the headrest bracket 330 pivots about the first pin 336, and the second pin 338 slides from the upper end of the curved portion 318*b* of the second slot 318 to the lower end of the curved portion 318*b* of the second slot 318. As a result, the second pin 338 is now located in the upper end of the linear portion 318*a* of the second slot 318. This position of the headrest bracket 330 is shown in FIG. 10.

To hold the headrest 230 in the upright position, first and second pins 336, 338 slide to the lower end of the first slot 316 and the linear portion 318*a* of the second slot 318, respectively. Gravity assists in keeping the first and second pins 336, 338 at the lower ends of their respective slots, and in this position, the headrest bracket 330 is prevented from rotating about the first pin 336 back to the folded position.

To move the headrest 230 from the upright position to the folded position, the process described above is reversed. A user lifts the headrest 230 to slide the first pin 336 from the lower end to the upper end of the first slot 316 and to slide the second pin 338 from the lower end to the upper end of the linear portion 318*a* of the second slot 318. Then the headrest 230 and headrest bracket 330 are pivoted about the first pin 336, as the second pin 338 moves from the lower end of the curved portion 318*b* of the second slot 318 to the upper end of the curved portion 318*b* of the second slot 318.

While the forgoing discussion references certain materials, those skilled in the art will recognize that any material suitable for use in a marine environment and having other suitable characteristics for performing the functions discuss above (for example, strength and wear resistance) may be used in this invention.

The embodiments discussed herein are examples of preferred embodiments of the present invention and are provided for illustrative purposes only. They are not intended to limit the scope of the invention. Although specific configurations, structures, materials, etc. have been shown and described, such are not limiting. Modifications and variations are contemplated within the scope of the invention, which is to be limited only by the scope of the accompanying claims.

What is claimed is:

1. An inboard watersports boat comprising:

a hull including a bow, a stern, a transom, and port and starboard gunwales;

a motor positioned in the stern of the boat, forward of the transom and along a centerline of the boat;

a propeller operatively connected to the motor, the propeller being located under the hull and forward of the transom;

a tow point for towing a watersports performer; and a plurality of aft-facing seats positioned in the stern of the boat, aft of the tow point, the plurality of aft-facing seats including an aft-facing seat positioned port of the centerline of the boat and an aft-facing seat positioned starboard of the centerline of the boat, each of the port and starboard aft-facing seats being configured to be occupied by a passenger and including:

(i) a seat bottom configured to support the passenger's buttocks and at least part of the passenger's legs, the seat bottom having (a) an aft portion that supports at least part of the passenger's thighs at a level higher than the passenger's buttocks and (b) a forward portion that is positioned at a level lower than the gunwales;

(ii) a seatback configured to support the passenger's back; and (iii) a headrest configured to support the passenger's head, the headrest being movable with respect to the seatback.

2. The inboard watersports boat of claim 1, wherein the seat bottom of each of the port and starboard aft-facing seats is inclined at a downward angle from aft to fore.

3. The inboard watersports boat of claim 2, further comprising a floor, wherein the downward angle of the seat bottom of each of the port and starboard aft-facing seats is from 5 degrees to 20 degrees relative to the floor.

4. The inboard watersports boat of claim 1, wherein the seat bottom of each of the port and starboard aft-facing seats includes at least one cushion.

5. The inboard watersports boat of claim 1, wherein the headrest is rotatable with respect to the seatback.

6. The inboard watersports boat of claim 1, wherein the tow point is provided on a tower that spans the port and starboard gunwales.

7. An inboard watersports boat comprising:

a hull including a bow, a stern, a transom, and port and starboard gunwales;

a motor positioned in the stern of the boat, forward of the transom and along a centerline of the boat;

a propeller operatively connected to the motor, the propeller being located under the hull and forward of the transom;

a tow point for towing a watersports performer;

a plurality of aft-facing seats positioned in the stern of the boat, aft of the tow point, the plurality of aft-facing seats including an aft-facing seat positioned port of the centerline of the boat and an aft-facing seat positioned starboard of the centerline of the boat, each of the port and starboard aft-facing seats being configured to be occupied by a passenger and including:

(i) a seat bottom configured to support the passenger's buttocks and at least part of the passenger's legs, the seat bottom having (a) an aft portion that supports at least part of the passenger's thighs at a level higher than the passenger's buttocks and (b) a forward portion that is positioned at a level lower than the gunwales; and (ii) a seatback configured to support the passenger's back; and a plurality of compartments, including a compartment associated with the port aft-facing seat and a compartment associated with the starboard aft-facing seat, the compartment associated with the port aft-facing seat being positioned on a port side of the motor and the compartment associated with the starboard aft-facing seat being positioned on a starboard side of the motor, wherein each of the port and starboard aft-facing seats is movable to allow access to the compartment associated with that aft-facing seat.

8. The inboard watersports boat of claim 7, wherein each of the plurality of compartments is accessible by pivoting the associated aft-facing seat upwardly.

9. The inboard watersports boat of claim 8, wherein each of the plurality of compartments is accessible by pivoting both the seat bottom and the seatback of the associated aft-facing seat upwardly.

10. The boat of claim 7, further comprising a plurality of pneumatic cylinders configured to assist upward movement of the port and starboard aft-facing seats and configured to hold each of the port and starboard aft-facing seats in a raised position.

11. The inboard watersports boat of claim 7, wherein the seat bottom of each of the port and starboard aft-facing seats is inclined at a downward angle from aft to fore.

12. The inboard watersports boat of claim 11, further comprising a floor, wherein the downward angle of the seat bottom of each of the port and starboard aft-facing seats is from 5 degrees to 20 degrees relative to the floor.

13. The inboard watersports boat of claim 7, wherein the seat bottom of each of the port and starboard aft-facing seats includes at least one cushion.

14. The inboard watersports boat of claim 7, further comprising a headrest configured to support the passenger's head, the headrest being movable with respect to the seatback.

15. An inboard watersports boat comprising:

a hull including a bow, a stern, a transom, and port and starboard gunwales;

a motor positioned in the stern of the boat, forward of the transom and along a centerline of the boat;

a propeller operatively connected to the motor, the propeller being located under the hull and forward of the transom;

a tower spanning the port and starboard gunwales, the tower including a tow point for towing a watersports performer;

a plurality of aft-facing seats positioned in the stern of the boat, aft of the tow point, the plurality of aft-facing seats including a port aft-facing seat positioned adjacent the motor on a port side of the centerline and a starboard aft-facing seat positioned adjacent the motor on the starboard side of the centerline, each of the port and starboard aft-facing seats being configured to be occupied by a passenger and including:

(i) a seat bottom configured to support the passenger's buttocks and at least part of the passenger's legs, the seat bottom having (a) an aft portion that supports at least part of the passenger's thighs at a level higher than the passenger's buttocks and (b) a forward portion that is positioned at a level lower than the gunwales; and (ii) a seatback configured to support the passenger's back; and a seat support structure associated with each of the port and starboard aft-facing seats, the seat support structure having a compartment therein.

16. The inboard watersports boat of claim 15, wherein each of the port and starboard aft-facing seats is movable to allow access to the compartment associated with that aft-facing seat.

17. The inboard watersports boat of claim 16, further comprising a swim platform extending aft of the transom, wherein each compartment is accessible from the swim platform.

18. The inboard watersports boat of claim 15, wherein the seat bottom of each of the port and starboard aft-facing seats is inclined at a downward angle from aft to fore.

19. The inboard watersports boat of claim 18, further comprising a floor, wherein the downward angle of the seat bottom of each of the port and starboard aft-facing seats is from 5 degrees to 20 degrees relative to the floor.

20. The inboard watersports boat of claim 15, wherein the seat bottom of each of the port and starboard aft-facing seats includes at least one cushion.

* * * * *